US010662639B2

(12) United States Patent
Shapiro et al.

(10) Patent No.: US 10,662,639 B2
(45) Date of Patent: May 26, 2020

(54) METHODS FOR ERECTING A WALL PANEL PROXIMATE AN OUTERMOST EDGE OF A LAND PARCEL

(71) Applicant: MSC Development, LLC, Matthews, NC (US)

(72) Inventors: Matthew Shapiro, Matthews, NC (US); Jack McLeod, Matthews, NC (US)

(73) Assignee: MSC Development, LLC, Matthews, NC (US)

( * ) Notice: Subject to any disclaimer, the term of this patent is extended or adjusted under 35 U.S.C. 154(b) by 0 days.

(21) Appl. No.: 16/261,055

(22) Filed: Jan. 29, 2019

(65) Prior Publication Data

US 2019/0249415 A1 Aug. 15, 2019

Related U.S. Application Data

(60) Provisional application No. 62/623,056, filed on Jan. 29, 2018.

(51) Int. Cl.

| | |
|---|---|
| ***E04B 1/00*** | (2006.01) |
| ***E04B 1/35*** | (2006.01) |
| ***E04B 2/00*** | (2006.01) |
| ***E04C 2/52*** | (2006.01) |
| *E04B 1/24* | (2006.01) |
| *E04B 1/19* | (2006.01) |

(52) U.S. Cl.

CPC ..... *E04B 1/355* (2013.01); *E04C 2/46* (2013.01); *E04C 2/52* (2013.01); *E04B 2001/1993* (2013.01); *E04B 2001/2484* (2013.01)

(58) Field of Classification Search

CPC ... E04B 1/355; E04B 1/35; E04B 1/22; E04B 2001/1993; E04B 2001/2484; E04C 2/46; E04C 2/48

USPC ..... 52/745.1, 741.1, 741.13, 79.14

See application file for complete search history.

(56) References Cited

U.S. PATENT DOCUMENTS

| | | | | |
|---|---|---|---|---|
| 5,953,864 | A * | 9/1999 | Beck | E04B 1/0007 403/DIG. 12 |
| 5,987,827 | A * | 11/1999 | Lord | B28B 7/0029 52/125.1 |
| 6,253,504 | B1 * | 7/2001 | Cohen | B28B 15/00 52/143 |
| 7,062,885 | B1 * | 6/2006 | Dickenson, Jr. | E02D 27/02 52/274 |
| 8,631,628 | B1 * | 1/2014 | Beicker | E04B 1/35 52/742.14 |
| 2010/0180519 | A1 * | 7/2010 | Carrion | E04B 1/04 52/79.14 |
| 2011/0126484 | A1 * | 6/2011 | Carrion | E04B 1/04 52/426 |

(Continued)

*Primary Examiner* — Chi Q Nguyen

(74) *Attorney, Agent, or Firm* — Troutman Sanders LLP; Christopher C. Close, Jr.; Micah B. Hensley

(57) ABSTRACT

A method for erecting a wall panel without wasting valuable floor area for wall panel bracing and erecting the wall panel from within the boundary of the land parcel on which the wall panel is being erected is disclosed. A support structure that is configured to both maintain a prestressed concrete wall panel in a generally vertical position and to provide storage space can be anchored to a floor slab. The wall panel can be lifted from within the land parcel and positioned between the support structure and the boundary of the land parcel. The wall panel can then be anchored to the support structure.

8 Claims, 5 Drawing Sheets

(56) References Cited

U.S. PATENT DOCUMENTS

| | | | | |
|---|---|---|---|---|
| 2011/0296769 | A1* | 12/2011 | Collins | E04B 1/003<br>52/79.1 |
| 2013/0074433 | A1* | 3/2013 | Ciuperca | E04B 1/355<br>52/426 |
| 2014/0130444 | A1* | 5/2014 | Beicker | E04B 1/35<br>52/741.13 |
| 2015/0211227 | A1* | 7/2015 | Collins | E04B 1/003<br>52/279 |

* cited by examiner

- PRIOR ART -

- PRIOR ART -

METHODS FOR ERECTING A WALL PANEL PROXIMATE AN OUTERMOST EDGE OF A LAND PARCEL

CROSS-REFERENCE TO RELATED APPLICATION

This application claims the benefit of U.S. Provisional Application No. 62/623,056, entitled "Methods for Erecting a Wall Panel Proximate an Outermost Edge of a Land Parcel", filed Jan. 29, 2018, the entire contents and substance of which are fully incorporated by reference.

BACKGROUND

Several methods exist for constructing a building, and more specifically, for erecting walls for a building. For example, walls may be constructed from precast and/or prestressed concrete exterior panels. In this method, walls may be formed, poured, and cured at an offsite facility (i.e., a location other than the worksite at which the walls will be installed), transported to the worksite, and installed by a crane or similar method. As another example, tilt-up walls may be erected to create the walls for a building. Tilt-up construction, also known as tilt-slab or tilt-wall construction, refers to the onsite formation of concrete walls. That is, horizontally extending forms are built at the worksite at which the walls will be installed, and concrete is poured into the forms and cured. Once cured, the forms are removed, and the tilt-up panels are erected by a crane or similar method. As will be appreciated, either method typically results in a wall panel having a relatively small thickness as compared to the width and height of the panel. Further, each wall panel is generally very heavy. For example, each wall panel may weigh up 140 tons, depending on the application. Thus, to maintain the wall panel in an upright position, bracing generally is required to, for example, resist lateral forces such as wind loads. The bracing typically comprises one or more legs or pole braces. Commonly, one end of a pole brace is affixed to a wall panel and the other end is anchored to a floor slab or other slab.

Typically, the pole braces can be positioned either inside the building or outside the building. As will be understood, anchoring to the inside of the building refers to anchoring where the pole braces are affixed to the interior side of the wall panels and anchored to, for example, a floor slab of the building. In many instances, such as, for example, when the resulting building is a storage facility, warehouse, or any other building where usable floor area is at a premium, inside anchoring is undesirable, as the space required for the pole braces translates to unusable floor area that is necessary for other construction-related tools and machines (e.g., a crane used to raise the walls into place). Additionally, for buildings taller than one wall panel, an additional "pour" or additional wall panel typically is required to be stacked atop the initial wall panel to meet the desired height of the building. This becomes problematic for wall panels anchored to the inside as there is not straightforward method to anchor the additional panels to the inside.

As shown in FIGS. 1A and 1B, and as will be understood, anchoring to the outside of the building refers to pole braces that are affixed to the exterior side of the wall panels and anchored to, for example, an extension of the floor slab of the building or some other slab or structure (or even the ground) exterior to the building. Alternatively, the wall panel can be anchored to a concrete block of sufficient height to maintain the wall in an upright position. Regardless of the bracing or anchoring method employed, outside anchoring can be undesirable. As will be appreciated, the parcel of land on which the building sits includes a finite land area, and bracing the wall panels on the outside of the building necessitates a smaller footprint of the building itself. That is, area of the land parcel that would otherwise be available to build on is instead set aside to provide space in which to install bracing. Alternatively, the bracing may encroach onto adjoining parcels. Thus, continuing the example in which the resulting building is a storage facility, warehouse, or any other building where usable floor area is at a premium, outside anchoring can also be undesirable, as the total usable space is once again diminished due to the space requirements of the bracing.

Additionally, erection of the wall panels is commonly accomplished by a crane that is positioned outside the footprint of the building being constructed. But due to space constraints, it may be difficult or impossible to position a crane outside the footprint of the building being constructed. For example, existing structures (e.g., existing buildings), the topography or vegetation (e.g., trees) of the land surrounding the parcel on which the building is being built, or other factors may surround the parcel. This further complicates the construction process and more specifically, erection of the wall panels.

SUMMARY

Aspects of the present disclosure provide methods for erecting a wall panel proximate an outermost edge of a land parcel. Aspect of the present disclosure also provide methods for erecting a wall panel such that the usable floor area of the building is maximized within the boundaries of the parcel on which the building is being constructed. Further, aspects of the present disclosure also provide methods for erecting a wall panel with all construction equipment and personnel located within the boundaries of the parcel.

According to an example implementation, a method is provided for erecting a wall panel from within a boundary of a land parcel on which the wall panel is to be erected. The method can include providing a floor slab having an edge proximate the boundary of the land parcel and anchoring a support structure to the floor slab proximate the edge. The support structure can be configured to both maintain a prestressed concrete wall panel in a generally vertical position and can provide storage space within the resulting building. The method can further include providing a crane within the boundary of the land parcel; lifting, with the crane, the prestressed concrete wall panel; and locating, with the crane, the prestressed concrete wall panel proximate the edge of the floor slab such that the prestressed concrete wall panel is positioned in a generally vertical orientation between the boundary of the land parcel and the support structure. The method can also include anchoring the prestressed concrete wall panel to the support structure.

Other implementations, features, and aspects of the disclosed technology are described in detail herein and are considered a part of the claimed disclosed technology and can be understood with reference to the following detailed description, accompanying drawings, and claims.

BRIEF DESCRIPTION OF THE FIGURES

Reference will now be made to the accompanying figures and flow diagrams, which are not necessarily drawn to scale.

DETAILED DESCRIPTION

Figure 1A:
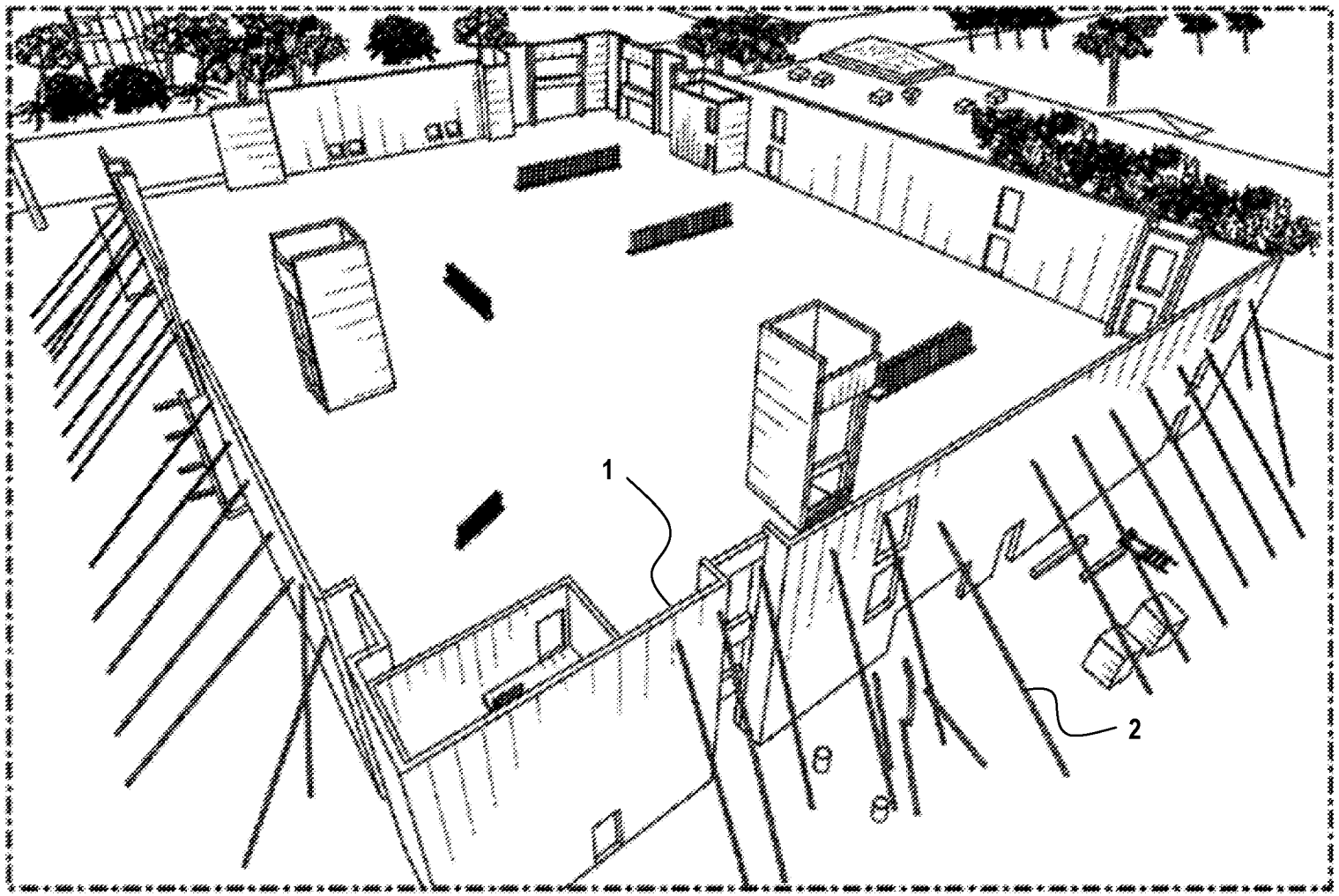
FIG. 1A illustrates wall panels that have been erected according to a prior art method employing outside bracing.

Implementations of the disclosed technology include novel techniques for erecting a wall panel from within a boundary of a land parcel on which the wall panel is to be erected. According to certain implementations, the wall panel may be positioned proximate an outermost boundary of the land parcel on which the wall panel is being erected so as to maximize the usable floor area of the resulting building of which the wall panel is a part.

Some implementations of the disclosed technology will be described more fully hereinafter with reference to the accompanying drawings. This disclosed technology may, however, be embodied in many different forms and should not be construed as limited to the implementations set forth therein.

In the following description, numerous specific details are set forth. But it is to be understood that implementations of the disclosed technology may be practiced without these specific details. In other instances, well-known methods, structures, and techniques have not been shown in detail in order not to obscure an understanding of this description. References to "one implementation," "an implementation," "example implementation," "some implementations," "certain implementations," "various implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

As previously discussed, several applications may make use of a building comprising a concrete floor slab and several concrete wall panels. To overcome the problems presented by current bracing techniques, it may be useful to use a brace frame or support structure that can support one or more wall panels and maintain them in a generally vertical orientation, such as providing resistance to wind loads, for example, while also providing usable space within the building. As will be appreciated, such usable space can provide room for a crane or lift used for erecting the walls, and the lack of pole braces within the structure can provide a safer work environment as workers do not have to navigate around the braces. Additionally, in a building that ultimately will become a self-storage facility, the bracing can be kept in place as the structure for the self-storage units.

Figure 1B:
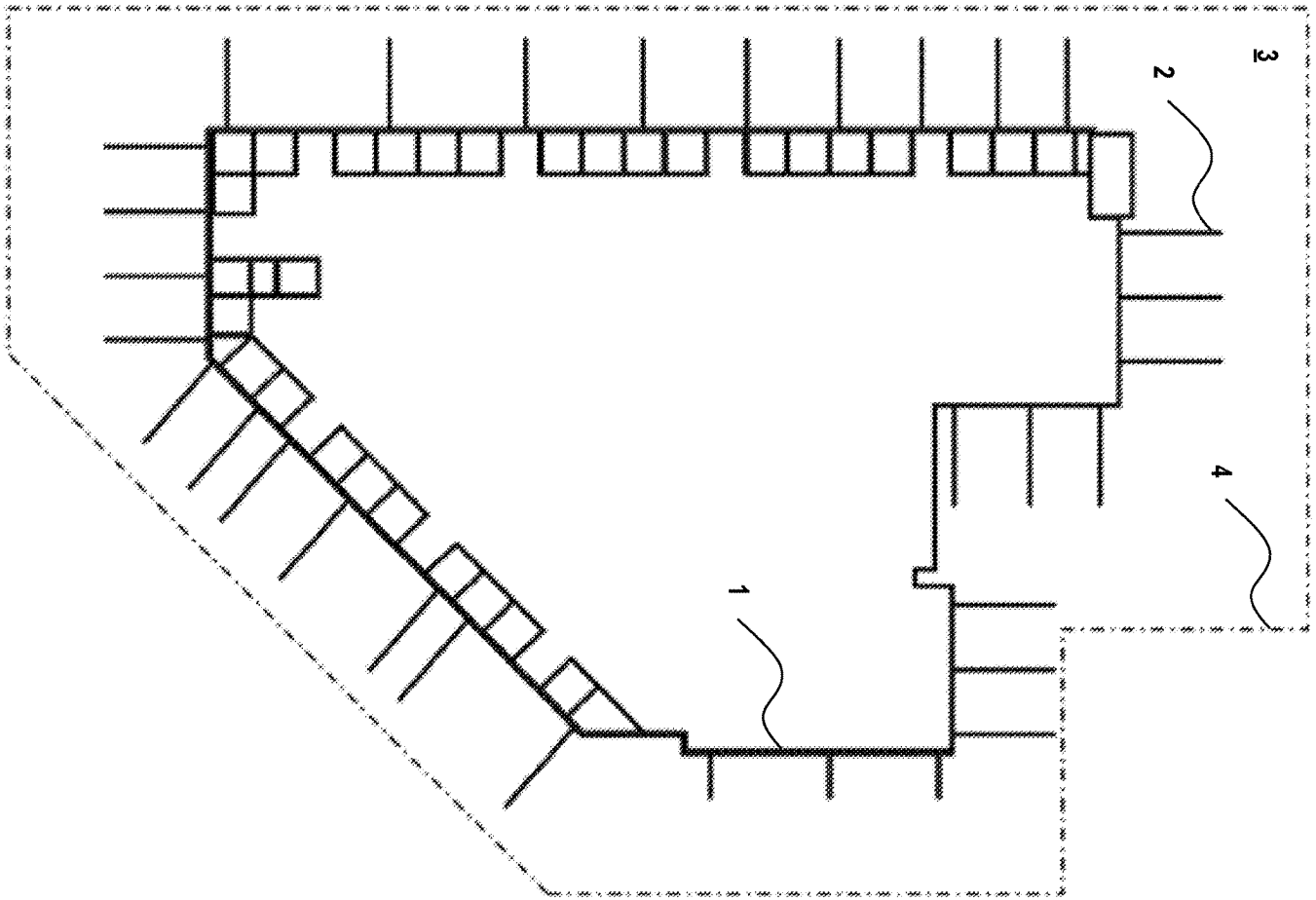
FIG. 1B is a plan view of a building erected on a land parcel according to a prior art method employing outside bracing.
Figure 2:
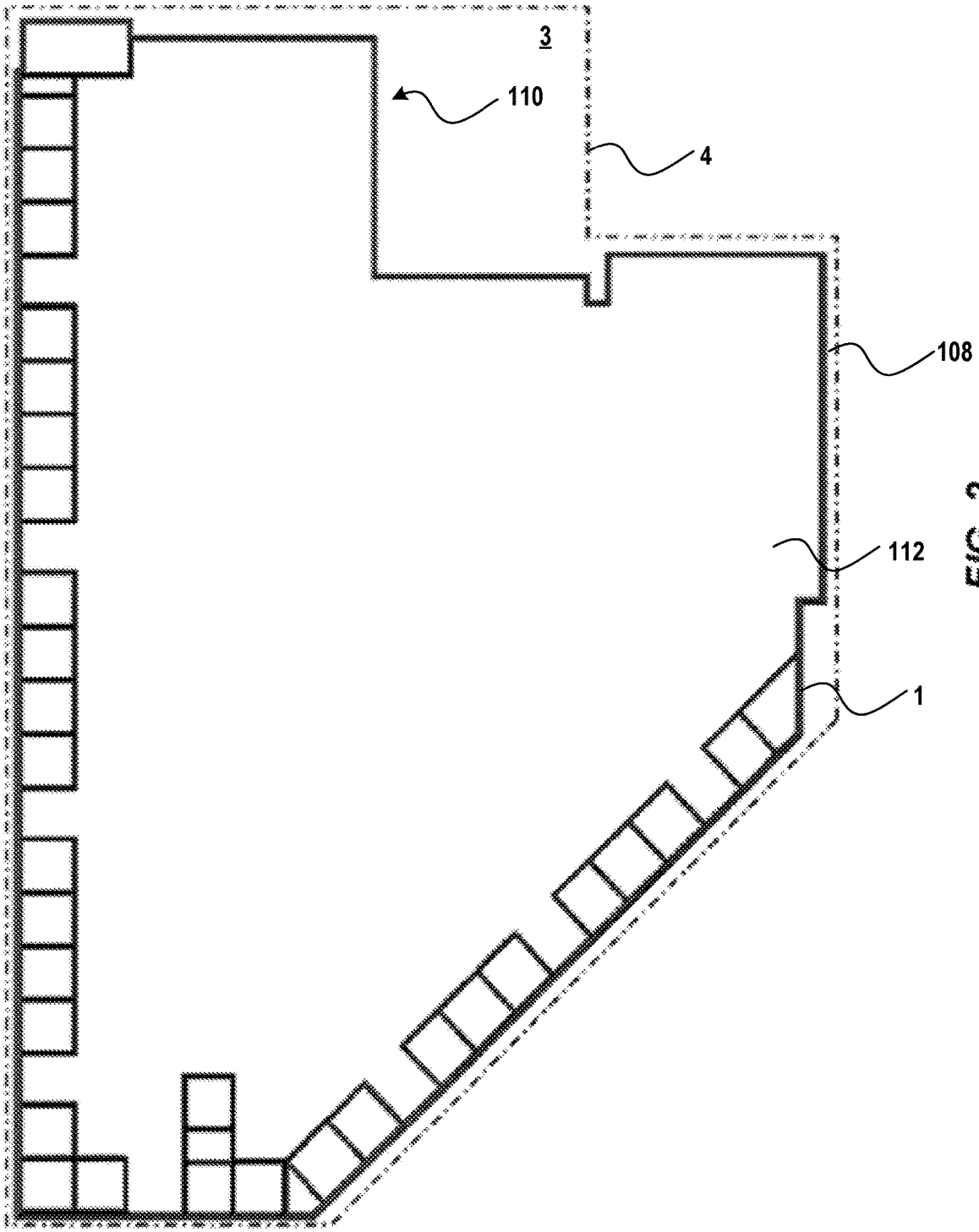
FIG. 2 is a plan view of a building comprising wall panels, according to example embodiments of the present disclosure. The building of FIG. 2 is located on a land parcel of the same size and shape as the prior art building shown in FIG. 1B.
Figure 3:
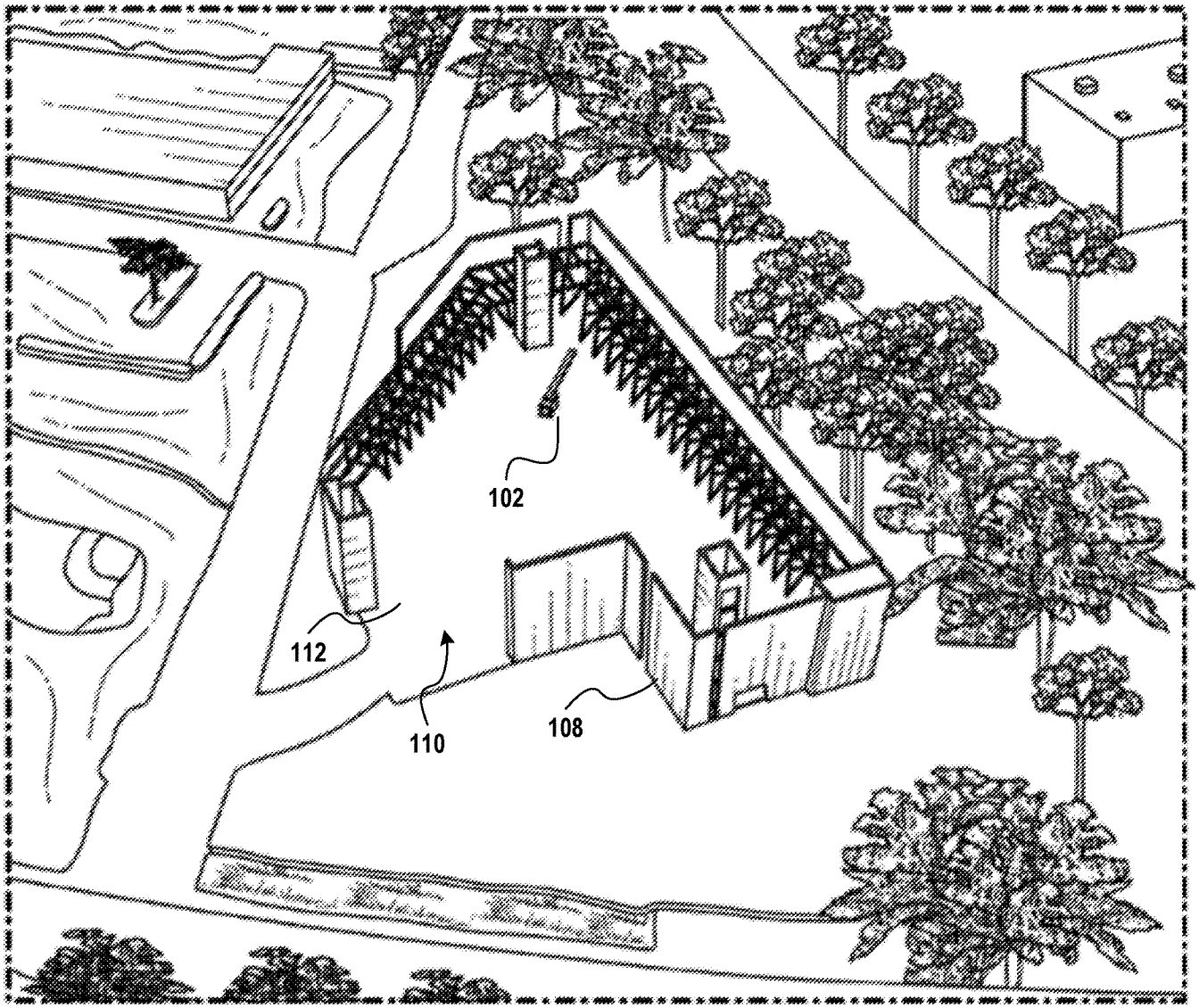
FIG. 3 illustrates an aerial view of a building being constructed at least partially according to the plan view of FIG. 2, according to example embodiments of the present disclosure.

To maximize the usable area in the building 1, in some embodiments, a foundation 110 and floor slab 112 may be constructed such that the foundation is at or near one or more boundaries of the land parcel 3 on which the building 1 is being constructed, as shown in FIGS. 2 and 3. Thus, the amount of land area between the building 1 and one or more of the parcel's boundaries 4 is minimized. A comparison between FIG. 1B and FIG. 2 illustrates this benefit of the disclosed technology. FIG. 1B illustrates a prior art building 1 including outside bracing 2 that is erected on a land parcel 3, and FIG. 2 illustrates a building 1 erected according to the technology disclosed herein that is built on a land parcel 3 of the same shape and size as the land parcel 3 in FIG. 1B. As can be seen from the figures, the outside bracings 2 prevent the prior art building 1 in FIG. 1B from fully utilizing the land area provided by the land parcel 3, whereas the building of FIG. 2, which was built according to the presently disclosed technology, permits the outside walls of the building to extend near the boundaries 4 of the land parcel 3, maximizing use of the land area provided by the land parcel 3. And as shown in FIG. 3, the disclosed technology enables walls 108 to be erected near the boundary 4 of a land parcel 3 without requiring a crane 102 to be positioned outside the boundary 4 of the land parcel 3. Instead, the crane 102 can erect the walls 108 of the building from within the footprint of the building 1, maximizing the useful area of the resulting building 1.

Figure 4:
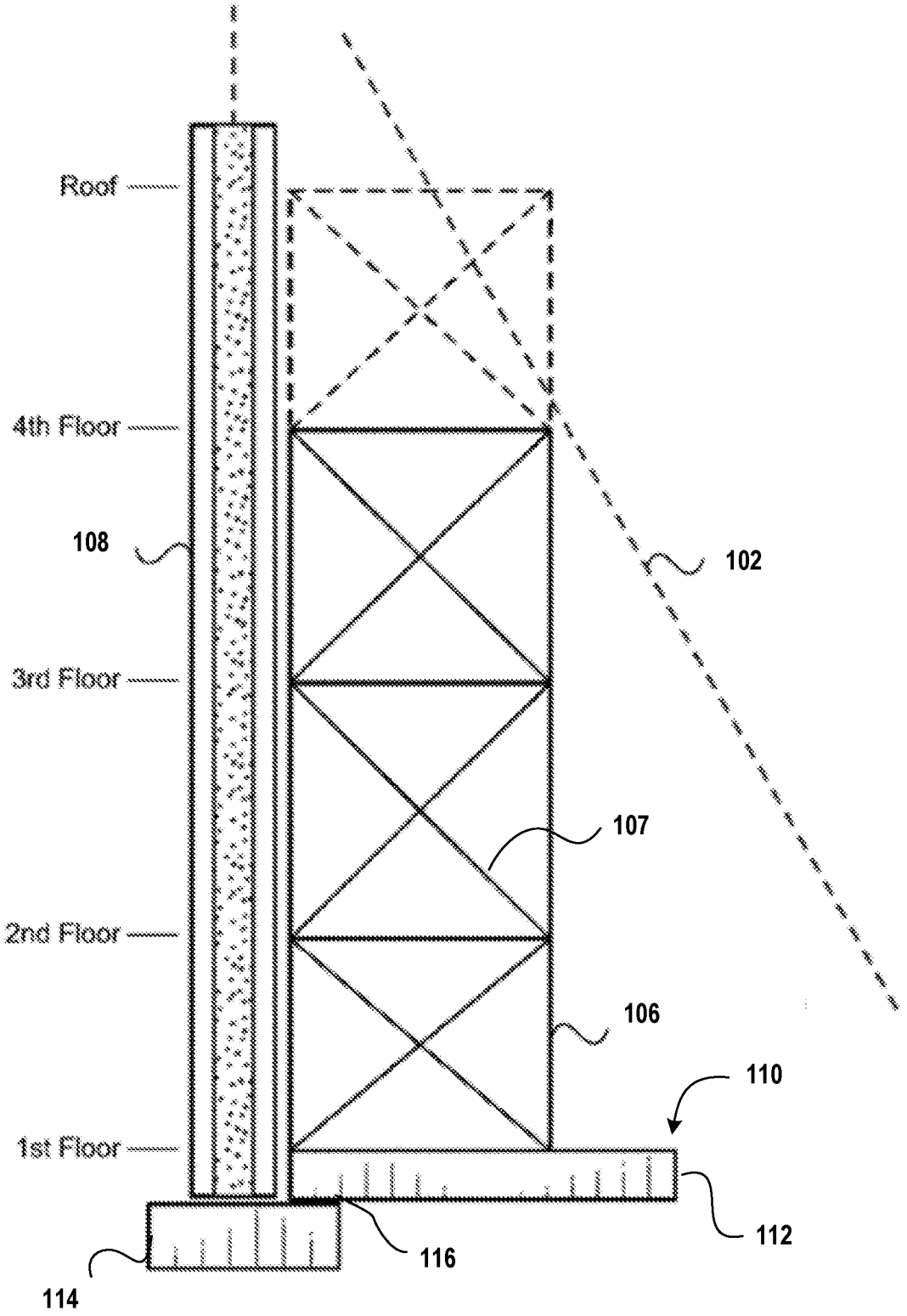
FIG. 4 is a side view schematic of a wall panel anchored to a support structure, according to example embodiments of the present disclosure.

As depicted in FIG. 4, according to some embodiments, a support structure 106 can be constructed using, for example, vertical columns of tube steel members along with horizontal I-beams and flat-bar cross brace members. In some embodiments, the various members 107 of the support structure 106 can be welded, bolted, or otherwise attached to one another to form the support structure 106, which can in turn become the structure for self-storage units. In some embodiments, adjacent support structures can be connected. For example, in certain embodiments, adjacent support structures may be connected by horizontal I-beams. In some embodiments, a support structure 106 may comprise only the amount of cross brace members required to resist seismic loads, wind loads, or any other loads identified by controlling rules and regulations. In some embodiments, the support structure 106 can be anchored to a floor slab 112, which can be a concrete slab. In certain embodiments, the support structure 106 can be anchored to a foundation 110. It may be useful or required to ensure the reliability of the anchors used to anchor the support structure 106 to the floor and/or foundation. Thus, a portion of the anchors may be subjected to pull testing to ensure the reliability of the anchors. Along the same lines, it may be useful to inspect any welds on the support structure 106 to ensure the welds meet certain criteria that is desired or required, such as by controlling rules and regulations.

An example methodology of anchoring the support structures 106 to the floor slab 112 can include drilling the floor slab 112 for frame anchor bolts, and anchoring the support structures 106 to the floor slab 112 using expansion anchors or anchor bolts that can be epoxy embedded.

An example methodology of erecting wall panels 108 according to certain aspects of the present disclosure can include pouring concrete to form a foundation 110. The foundation 110 can include a floor slab 112 and footing 114. The foundation 110 can have one or more outer edges that are in close proximity to a boundary 4 of the land parcel 3 on which the foundation 110 has been poured. For example, an outer edge 116 of the foundation 110 may be disposed 1", 2", 3", 4", 6", 10", 12", 18", 24" or 36" from the boundary 103 of the land parcel 3. As another example, the foundation 110 may abut the boundary 4 of the land parcel 3. The method can include drilling anchor holes into the floor slab 112 such that the anchor holes will align with support structures 106 and embedding the anchor bolts into the floor slab 112 (e.g., with epoxy). The method can include erecting a support structure 106, which can be erected as a single structure or modularly. The method can include attaching the support structure 106 to the floor slab 112 via the anchor bolts and can include welding a strap (e.g., a PSA strap) to the support structure 106. The method can include providing a foundation connection, which may include anchoring a foundation anchor into the foundation (e.g., proximate an edge of the foundation) and may also include welding an angle to a panel embed plate. The angle may be galvanized, which may extend the useful life of the angle. The method can include transporting a crane 102 onto the floor slab 112 and positioning, by the crane 102, a wall panel 108 onto the foundation 110 between the edge 116 of the foundation 110 and the support structure 106. The wall panel 108 may comprise concrete, and/or the wall panel 108 may be a prestressed concrete wall panel.

As will be appreciated, wall panels are typically rectangular in shape such that the panels have a length that is longer than its width. The method may include positioning one or more wall panels in a generally vertical position (i.e., the length of the wall panel is extending in a direction that is substantially normal to the top surface of the floor slab). The method may include, during position of the one or more wall panels, aligning the one or more wall panels with the foundation connection, which may help facilitate an upright outer wall.

In some embodiments, the method may include positioning one or more wall panels in a generally horizontal position (i.e., the length of the wall panel is extending in a direction that is substantially parallel to the top surface of the floor slab). This may provide substantially increased protection for the building against high winds, hurricanes, and other environmental events.

The method may include positioning a crane 102 on the floor slab 112. The crane 102 may be positioned on the floor slab 112 after the support structure 106 is in place, or the crane 102 may be used to assist in erecting the support structure 106. The method may include using the crane 102 to lift and move the wall panels 108 into position, such that the wall panels 108 are located at or near one or more boundaries 4 of the land parcel 3. This may require the crane 102 to lift the wall panels 108 over the top of the support structure 106. The method may include anchoring, attaching, or otherwise affixing the wall panels 108 to the foundation 110, floor slab 112, and/or support structures 106. For example, in some embodiments, the wall panels 108 can be attached to the support structures 106 via one or more PSA straps (which may have been previously welded to the wall panels 108 as an earlier step of this method). Such a methodology may reduce the time necessary to install the wall panels 108, requiring as little as 45 minutes to erect and install each panel. Such a methodology may also require less equipment and fewer man-hours as compared to traditional methods and may also provide a safer technique for installing or erecting wall panels 108, such as concrete wall panels.

Exemplary Use Cases

The following exemplary use cases describe examples of a typical user flow pattern. They are intended solely for explanatory purposes and not limitation. In an example use case, a foundation (e.g. foundation 110) comprising footings (e.g. footing 114) and a 10-inch thick floor slab (e.g. floor slab 112) is constructed on a land parcel (e.g. land parcel 3) such that at least one edge (e.g. edge 116) of the foundation is at or near a boundary (e.g. boundary 4) of the land parcel 3. The foundation and floor slab are poured with concrete. Holes for anchors of the support structures (e.g. support structure 106) are predrilled into foundation or floor slab. Anchors are embedded into the predrilled holes using, for example, epoxy. Alternatively, expansion anchors are used. The support structures are constructed. Each support structure comprises three stalls (i.e., self-storage stalls) and is approximately 30'-3" tall. A large crane (e.g. crane 102), for example a 210-ton crane, is transported onto the floor slab and is moved into position to erect the wall panels (e.g. wall panel 108), which are each 45'-4" tall. The crane lifts a wall panel over a support structure and places the wall panel proximate the edge of the foundation. A panel-to-foundation connection is used to attach the wall panel to the foundation, and the panel-to-foundation connection comprises an expansion anchor and a galvanized angle welded to a panel's embed plate. The wall panel is attached to the support structure at or near the top of the support structure (e.g., at the fourth-floor level in the schematic of FIG. 4) using a PSA strap welded to a horizontal I-beam. Once the PSA strap at the fourth-floor level is connected, the crane's rigging is released from the wall panel, permitting the crane to lift and position a subsequent wall panel. After the crane's rigging is removed, PSA straps are welded at the third-floor and second-floor levels. In situations where high winds or other inclement weather is expected, the crane rigging can remain in place until the third-floor and second-floor PSA straps are welded to the support structure.

While certain techniques and methods of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain implementations of the disclosed technology, including the best mode, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for erecting a wall panel from within a boundary of a land parcel on which the wall panel is to be erected, the method comprising:

providing a floor slab having an edge proximate the boundary of the land parcel;

anchoring a support structure to the floor slab proximate the edge, the support structure configured to both maintain a prestressed concrete wall panel in a generally vertical position and to provide storage space;

providing a crane within the boundary of the land parcel and disposed upon the floor slab;

lifting, with the crane, the prestressed concrete wall panel;

locating, with the crane, the prestressed concrete wall panel proximate the edge of the floor slab such that the prestressed concrete wall panel is positioned in the generally vertical orientation between the boundary of the land parcel and support structure; and anchoring the prestressed concrete wall panel to the support structure.

2. A method for erecting a wall panel from within a boundary of a land parcel on which the wall panel is to be erected, the method comprising:

pouring concrete to form a foundation comprising a floor slab and footings, the foundation having an edge proximate the boundary of the land parcel;

drilling anchor holes into the floor slab proximate the edge of the foundation;

embedding, with epoxy, anchor bolts into the floor slab;

erecting a support structure;

attaching the support structure to the anchor bolts;

providing a foundation connection comprising anchoring a foundation anchor to the foundation proximate the edge and welding a galvanized angle to a panel embed plate;

transporting a crane onto the floor slab;

positioning, with the crane disposed upon the floor slab, the wall panel onto the foundation between the edge of the foundation and the support structure; and anchoring the wall panel to the support structure.

3. The method of claim 2, wherein the wall panel comprises prestressed concrete.

4. The method of claim 2, wherein positioning the wall panel comprises aligning the wall panel with the foundation connection.

5. The method of claim 2, wherein the wall panel has a length and a width, the length being longer than the width, wherein positioning the wall panel comprises positioning the wall panel in a generally vertical orientation such that the length is extending in a direction that is substantially normal to the top surface of the floor slab.

6. The method of claim 2, wherein the wall panel has a length and a width, the length being longer than the width, wherein positioning the wall panel comprises positioning the wall panel in a generally horizontal orientation such that the length is extending in a direction that is substantially parallel to the top surface of the floor slab.

7. The method of claim 2 further comprising welding a PSA strap to the support structure, wherein anchoring the wall panel to the support structure comprises connecting the PSA strap to the support structure.

8. The method of claim 2, wherein the support structure serves as a structure for self-storage units.

* * * * *